US005285554A

United States Patent [19]

Jean et al.

[11] Patent Number: 5,285,554

[45] Date of Patent: Feb. 15, 1994

[54] SPREADING AND LAP-FORMING MACHINE

[75] Inventors: Robert Jean, Fouqueville; Bernard Chatelet; Bernard Jourde, both of Elbeuf, all of France

[73] Assignee: Asselin (Societe Anonyme), Elbeuf, France

[21] Appl. No.: 969,830

[22] PCT Filed: May 27, 1992

[86] PCT No.: PCT/FR92/00472

§ 371 Date: Feb. 1, 1993

§ 102(e) Date: Feb. 1, 1993

[87] PCT Pub. No.: WO92/21802

PCT Pub. Date: Dec. 10, 1992

[30] Foreign Application Priority Data

Jun. 3, 1991 [FR] France ..... 91 06633

[51] Int. Cl.[5] ..... D01G 25/00; D04H 1/74

[52] U.S. Cl. ..... 19/163; 270/31

[58] Field of Search ..... 19/161.1, 163; 270/30, 270/31, 39; 493/409, 410, 411, 412, 413, 414, 415, 416, 417, DIG. 937

[56] References Cited

U.S. PATENT DOCUMENTS

| | | | |
|---|---|---|---|
| 492,116 | 2/1893 | Smith | 270/30 |
| 1,886,919 | 11/1932 | Sturgis . | |
| 2,428,709 | 10/1947 | Hlavaty | 19/163 |
| 3,558,029 | 1/1971 | Manns | 19/163 X |
| 3,638,279 | 2/1972 | Swados . | |
| 4,194,270 | 3/1980 | Hille | 19/163 |
| 5,046,709 | 9/1991 | Beal | 270/30 |

FOREIGN PATENT DOCUMENTS

| | | | |
|---|---|---|---|
| 2542274 | 1/1977 | Fed. Rep. of Germany . | |
| 2373095 | 6/1978 | France . | |
| 929028 | 6/1963 | United Kingdom | 19/163 |
| 1434703 | 5/1976 | United Kingdom | 19/163 |
| 1527230 | 10/1978 | United Kingdom . | |

*Primary Examiner*—Clifford D. Crowder
*Assistant Examiner*—John J. Calvert
*Attorney, Agent, or Firm*—Young & Thompson

[57] ABSTRACT

A web of fibers (4) is conveyed by conveyor-belts (2, 5) which pass around rollers (32 to 43, 60 to 69). Some of these rollers are carried by main carriages (10, 14) which are capable of displacement in reciprocating motion above an apron (8) which moves in a direction parallel to the axes of the rollers and collects the web (4) in the form of a lap. Auxiliary carriages (16, 18) are provided for maintaining the length of the paths of the conveyor-belts (2, 5) at a constant value in spite of the reciprocating movements of the main carriages (10, 14). Each auxiliary carriage (16, 18) is located within a bottom passageway (70) which extends beneath the apron (8) and is separated from the apron by at least one partition-wall (72).

The invention is applicable to the manufacture of non-woven fabrics.

6 Claims, 6 Drawing Sheets

SPREADING AND LAP-FORMING MACHINE

BACKGROUND OF THE INVENTION

1. Field of the Invention

The present invention relates to a spreading and lap-forming machine for converting a web to a lap by folding in pleats.

2. Description of the Prior Art

In a machine of this type as disclosed, for example, in patent document FR-B-2,553,102, a web delivered by a card is first conveyed by a first conveyor-belt or so-called front belt to a pinching zone in which it is maintained between the first belt and a second belt and conveyed to an output carriage. The reciprocating motion of the output carriage above a receiving apron causes deposition of the web which said carriage discharges onto the apron in alternate accordion pleats. Since the apron moves in a direction parallel to the axes of the guide rollers carried by the output carriage, the successive pleats are relatively displaced along this direction and the web thus forms on the apron a continuous lap, the lateral edges of which are defined by the pleats. The beginning of the pinching zone is defined as a position in motion by an input carriage which performs a reciprocating movement. This movement is intended to ensure that the speed of admission of the web into the spreading machine is made compatible with the speed of unwinding of the web by the output carriage in spite of the reciprocating movements of said carriage. Thus the web, which has a fragile structure, is not disturbed either by packing or by stretching or by friction.

In machines of this type, the developed length of the closed paths followed by the conveyor-belts must be maintained constant in spite of the reciprocating movements of the carriages.

In some designs, the reciprocating motion of the input carriage is compensated by the contrary reciprocating motion of the output carriage and conversely by means of a suitable arrangement of the guide rollers (reference can be made, for example, to patent document FR-B-2,553,102).

In other designs (see FR-B-2,234, 395, U.S. Pat. No. 1,886,919 or FR-A-2,373,095), provision is made for one or a number of auxiliary carriages which also carry out reciprocating movements of translation in order to selectively lengthen or shorten the conveyor-belts outside the pinching zone and thus to compensate for variations in length of the pinching zone.

The present Application is more particularly concerned with this second type of construction.

It has been found that spreading and lap-forming machines of this type give rise to difficulties when they operate at the high speeds which may be desired in order to increase production rates. The alternating motion of the auxiliary carriages in that case produces relatively violent air currents which tend to disperse the web conveyed on the front belt upstream of the input carriage. This may result in defects in homogeneity of the lap produced and even in jamming of the web in the pinching zone.

In the spreading and lap-forming device described in patent document U.S. Pat. No. 1,886,919, the auxiliary carriages are slidably mounted within the closed loop described by the apron which receives the lap. Their reciprocating movements therefore produce air currents in the vicinity of the lap deposited on the apron, with the result that this spreading and lap-forming device cannot produce a uniform lap at relatively high speeds.

In the spreading and lap-forming device described in patent document FR-A-2,373,095, the auxiliary carriage moves above the input carriage. This structure reduces the disturbing effect of the movement of the auxiliary carriage on the formed lap in comparison with U.S. Pat. No. 1,886,919. However, this disturbing effect is in fact exerted on the web which is supplied to the input of the machine. This results in the same disadvantage: uniformity of the lap formed at the exit of the spreading machine is poor, particularly at high speed.

One of the objects of the present invention is to solve these difficulties and to provide a spreading and lap-forming machine which produces a uniform lap, even at high speed.

SUMMARY OF THE INVENTION

The spreading and lap-forming machine in accordance with the present invention comprises two conveyor-belts which are each intended to follow a closed path and are associated with rollers for respective guiding and displacement of said conveyor-belts, the closed paths being external to each other and adjacent to each other in a pinching zone delimited by guide rollers carried by two main carriages which are capable of displacement in translational motion in a horizontal direction at right angles to the axes of the rollers, compensating means including at least one auxiliary carriage which is capable of displacement in translational motion at right angles to the axes of the rollers so as to maintain the length of each closed path at a substantially constant value, each closed path being intended to make a 180-degree turn around at least one guide roller carried by an auxiliary carriage, means for bringing the web to the entrance of the pinching zone, an apron which is capable of moving in a direction parallel to the axes of the rollers and receives the web as it passes out of the pinching zone, and driving means for applying reciprocating movements of translation to the main carriages and to the compensating means.

In accordance with the invention, said spreading and lap-forming machine is distinguished by the fact that each auxiliary carriage is located within a bottom passageway which extends beneath the apron and is separated therefrom by means such as a partition-wall whereby air currents generated in particular by the auxiliary carriages are prevented from propagating to the web and/or the lap which is being formed.

By virtue of this arrangement, the air currents produced by the reciprocating motion of the auxiliary carriages fail to reach the level of the web or of the lap or at least reach them in a substantially attenuated state since they remain essentially confined to the interior of the bottom passageway. In consequence, these movements practically do not affect the regularity of transfer of the web and the formed lap therefore has improved homogeneity.

DETAILED DESCRIPTION OF THE INVENTION

Figure 1:
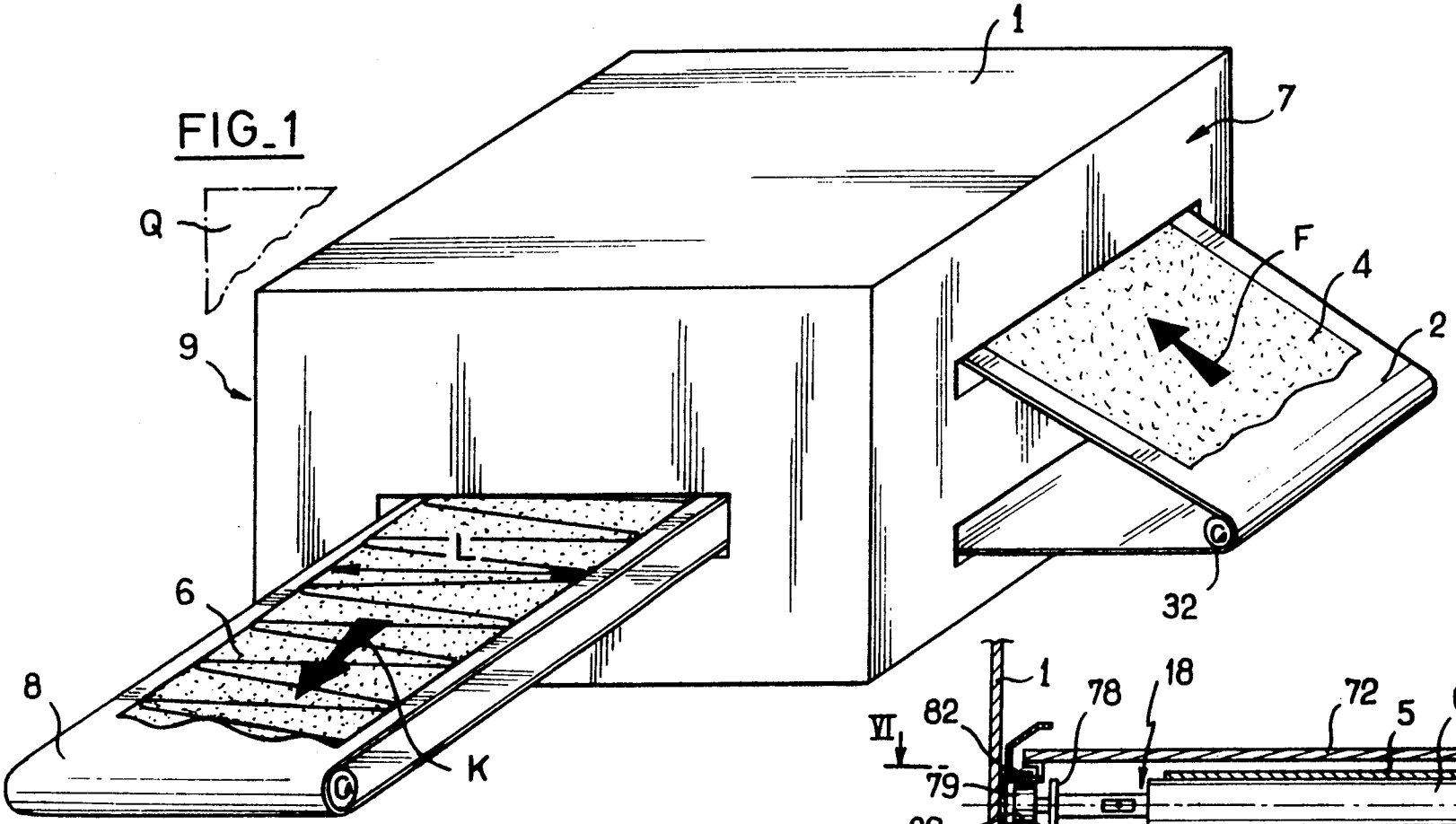
FIG. 1 is an external view in perspective showing a spreading and lap-forming machine.

The spreading and lap-forming machine shown in perspective in FIG. 1 includes a first conveyor-belt 2 or so-called front belt which collects the web of fibers 4 delivered for example by a card (not shown) and conveys it into the enclosure 1 in which it is converted by folding to a lap 6, said lap being conveyed by an apron 8 to the exterior of the enclosure 1. The apron 8 conveys the formed lap 6, for example to a needle-punching unit (not shown). The directions of conveyance of the web 4 and of the lap 6 are respectively indicated in FIG. 1 by the arrows F and K. For reference purposes, the expression "front side" of the spreading and lap-forming unit will designate the side 7 adjacent to the face through which the web 4 is admitted and the "rear side" of the spreading and lap-forming unit will designate the side 9 opposite to the front side 7.

Figure 2:
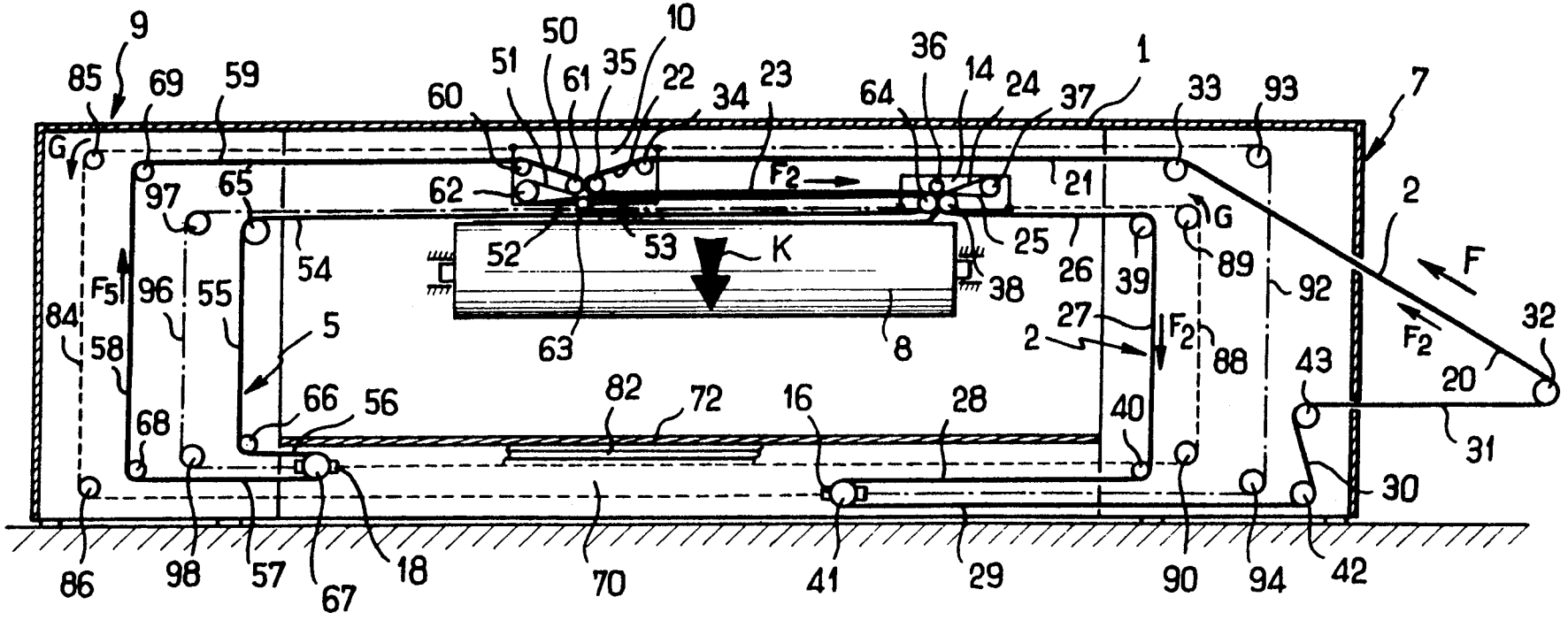
FIGS. 2 to 4 are schematic views in elevation showing a spreading and lap-forming machine in accordance with the invention in three different positions.
Figure 3:
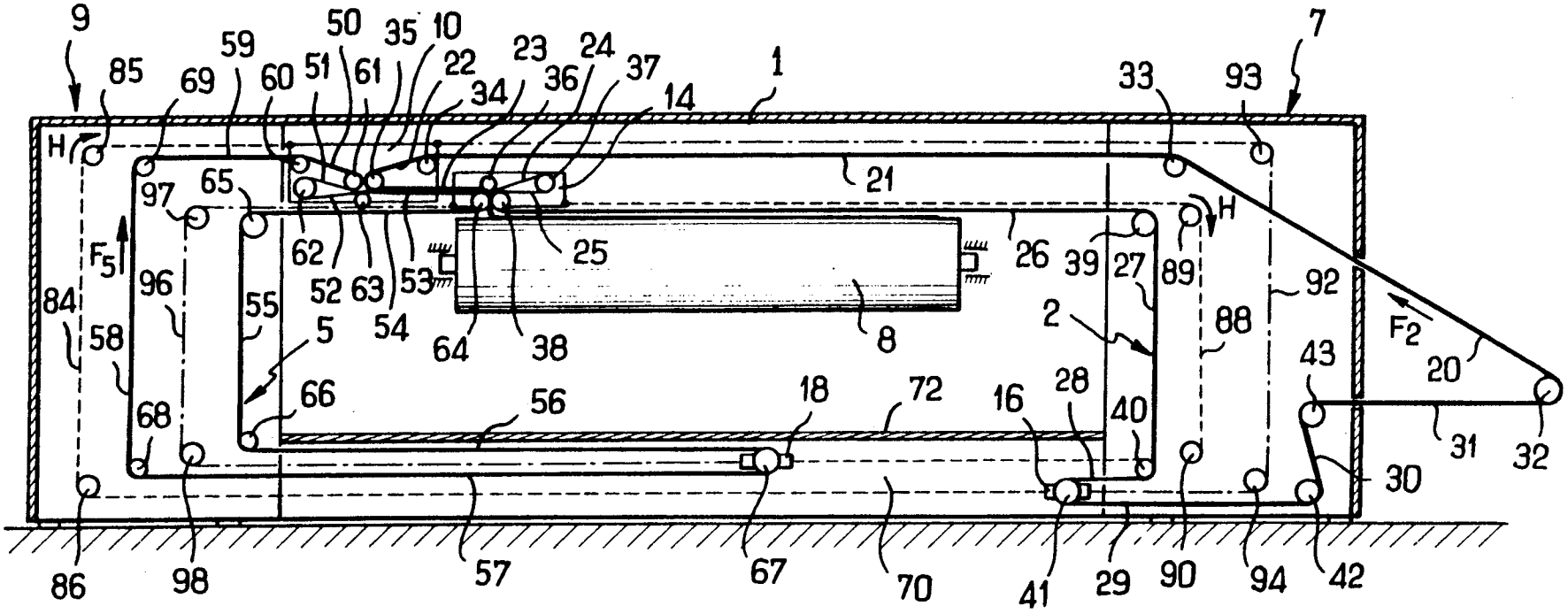
Figure 4:
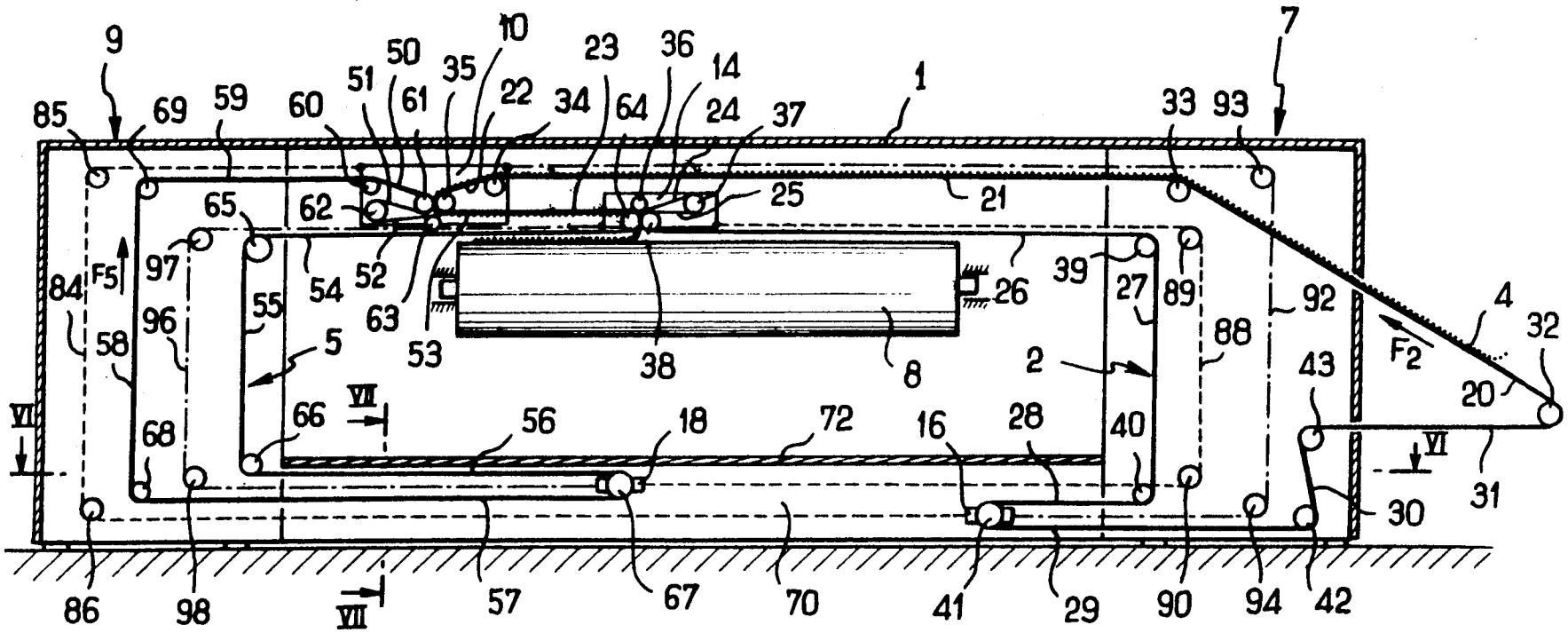

The interior of the spreading and lap-forming machine is illustrated schematically in the views in elevation of FIGS. 2 to 4, these views being taken along a plane Q perpendicular to the direction of conveyance of the lap 6 by the apron 8.

The spreading and lap-forming machine includes a second conveyor-belt 5 or so-called rear belt which is associated with the front belt 2. The belts 2 and 5 shown in full lines in FIGS. 2 to 4 have the same width and their lateral edges are located in the same planes parallel to the plane of FIGS. 2 to 4. The front belt 2 follows a closed path made up of sections 20 to 31 delimited by cylindrical guide rollers 32 to 43. The rear belt 5 follows a closed path made up of sections 50 to 59 delimited by cylindrical guide rollers 60 to 69.

The guide rollers 32 to 43, 60 to 69 are pivotally mounted about respective axes which are perpendicular to the plane of FIGS. 2 to 4 or in other words parallel to the direction of motion of the apron 8. The shafts of the rollers 32, 33, 39, 40, 42, 43 and 65, 66, 68, 69 are stationary with respect to the frame 1 of the spreading and lap-forming machine. The shafts of the rollers 34, 35 and 60, 61, 62, 63 are carried by a first main moving carriage 10 or so-called input carriage. The shafts of the rollers 36, 37, 38 and 64 are carried by a second main moving carriage 14 or so-called output carriage and the shafts of the rollers 41 and 67 are carried by auxiliary carriages 16, 18.

For each closed path 20 to 31, 50 to 59 of the conveyor-belts, an auxiliary moving carriage 16, 18 carries a guide roller 41, 67 about which said closed path makes a turn through an angle of 180 degrees. The two auxiliary carriages 16, 18 have movements which compensate those of the main carriages 10, 14 so as to maintain substantially constant the length of each of the closed paths 20 to 31, 50 to 59.

In the case of each conveyor-belt 2, 5, at least one of the stationary-shaft rollers (for example the rollers numbered respectively 39 and 65) is driven in rotation by known means (not shown) so as to cause the belts 2, 5 to travel along their respective closed paths 20 to 31, 50 to 59 in accordance with predetermined kinematic laws. The directions of travel of the belts 2, 5 are indicated respectively by the arrows F2, F5 in FIGS. 2 to 4.

The closed paths 20 to 31, 50 to 59 are external to each other and adjacent to each other in a pinching zone in which the moving belt sections numbered 23 and 53 in FIGS. 2 to 5 are located against each other so as to pinch the web 4 between them. The web 4 is shown as a dotted line in FIG. 4 but is not illustrated in FIGS. 2 and 3 in order to show the superposed arrangement of the belt sections 23, 53.

The adjacent horizontal sections 23, 53 of the closed paths followed by the two belts 2, 5 in the pinching zone are delimited at the entrance of the pinching zone by guide rollers 35, 61 carried by the input carriage 10 and, at the exit of the pinching zone, by guide rollers 38, 64 carried by the output carriage 14.

The main carriages 10, 14 are located above the apron 8 and are capable of displacement in reciprocating translational motion in a horizontal direction perpendicular to the axes of the rollers 32 to 43, 60 to 69.

The input carriage 10 (as also shown in the more detailed view of FIG. 5) carries two guide rollers 34, 35 for the front belt 2 and located on the inside of its closed path 20 to 31. Upstream of the input carriage 10, the front belt 2 which carries the web 4 follows the substantially horizontal section 21 which comes from the front side 7. As it reaches the input carriage 10, the front belt 2 makes a first turn around the guide roller 34 through an angle A which is within the range of 0 to 90 degrees and is oriented downwards in order to form the sloping section 22, then makes a second turn around the roller 35 through an angle B within the range of 90 to 180 degrees so as to constitute the horizontal section 23 of the pinching zone, said horizontal section being directed towards the front side 7 of the spreading and lap-forming machine. The total angular deviation A+B of the front belt 2 about the guide rollers 34, 35 carried by the input carriage 10 is equal to 180 degrees.

The input carriage 10 carries in addition four guide rollers 60, 61, 62, 63 associated with the rear conveyor-belt 5, the rollers 60, 61 and 63 being internal to its closed path 50 to 59 and the roller 62 of larger radius, or so-called detour roller, being external to said closed path 50 to 59. Upstream of the input carriage 10, the rear belt 5, which does not carry the web 4, follows the substantially horizontal section 59 which comes from the rear side 9. As it reaches the input carriage 10, the rear belt 5 makes a first turn around the guide roller 60 through an angle C which is within the range of 0 to 90 degrees and is oriented downwards so as to pass into the section 50, then makes a second turn through 180 degrees around the roller 61 so as to pass into the section 51, then makes a third turn around the detour roller 62 through a negative angle greater than 180 degrees (since the detour roller 62 is external to the closed path 50 to 59) and finally makes a fourth turn around the roller 63 in order to pass into the horizontal section 53 of the pinching zone, said horizontal section being directed towards the front side 7 of the spreading and lap-forming unit. The total angular deviation of the rear belt 5 about the guide rollers 60, 61, 62, 63 carried by the input carriage 10 is zero.

Figure 5:
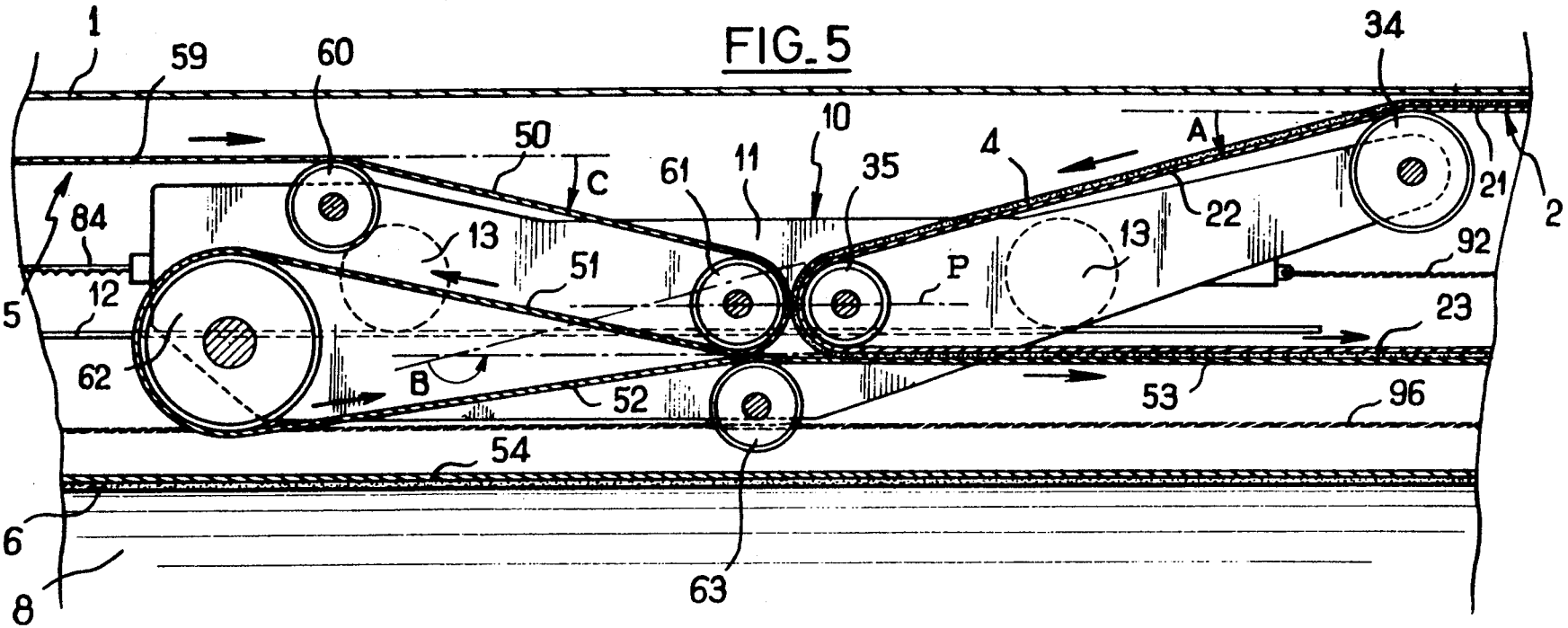
FIG. 5 is a view in elevation to a larger scale showing in greater detail the input carriage of the spreading and lap-forming machine of FIGS. 2 to 4.

It is apparent from FIG. 5 that the two conveyor-belts 2, 5 as well as the web 4 which passes between them are pinched along a pinching line defined between the two rollers 35, 61 and constituting the entrance of the pinching zone. The respective axes of these two pinching rollers 35, 61 are located in the same horizontal plane P. As it passes around the roller 63 located on the input carriage 10 beneath the horizontal plane P, the rear belt 5 is supported and meets the front belt 2 tangentially in the pinching zone 23, 53. The web 4 engages in the pinching zone 23, 53 after having been conveyed on the sections 20, 21, 22 of the path of the front belt 2 and after having passed between the belts 2, 5 which are pinched between the rollers 35, 61 along the pinching line. These pinching rollers 35, 61 can be thrust resiliently towards each other by known restoring means (not shown in the drawings).

Figure 8:
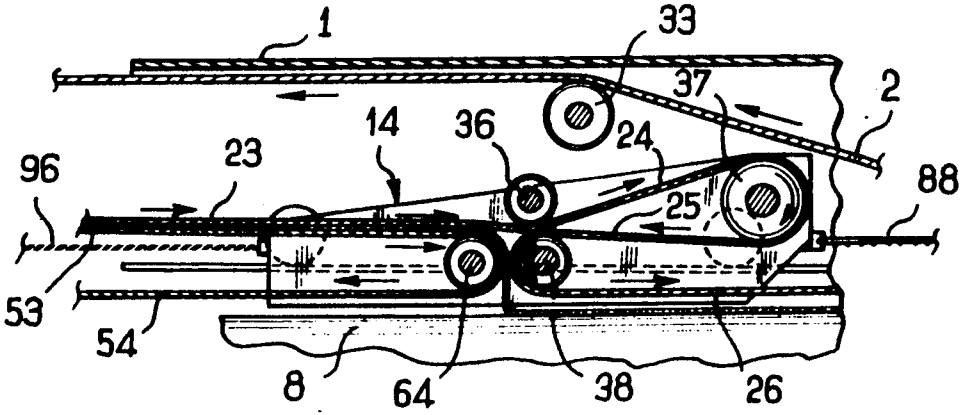
FIG. 8 is a view which is similar to FIG. 5 and shows the output carriage of the spreading and lap-forming machine.

The input carriage 10 has two side-plates 11 located on each side of the rollers 34, 35, 60, 61, 62, 63 which it carries. The ends of the respective shafts of said rollers 34, 35, 60, 61, 62, 63 are fixed on the side-plates 11. On the faces remote from the rollers 34, 35, 60, 61, 62, 63, the side-plates 11 of the input carriage 10 carry wheels 13 which are capable of pivoting about a horizontal axis and are placed on a horizontal lateral ramp 12 rigidly fixed to the frame 1 of the spreading and lap-forming machine so as to guide the input carriage 10 in its movement of translation. A similar structure which is visible in FIG. 8 is provided for guiding the output carriage 14 in its movement of translation.

At the exit of the pinching zone 23, 53, the two belts 2, 5 pass between two delivery pinching rollers 38, 64 carried by the output carriage 14 (as shown in FIGS. 2 to 4 and 8). The respective shafts of these two delivery rollers 38, 64 are in the same horizontal plane located above the apron 8.

Around the pinching roller 64, the rear belt 5 turns through an angle of 180 degrees in order to pass from the horizontal section 53 which forms part of the pinching zone to a horizontal section 54 which extends immediately above the apron 8. Said horizontal section 54 passes beneath the input carriage 10 so as to meet a guide roller 65 having a stationary shaft and located on the rear side 9 of the spreading and lap-forming unit.

In addition to the pinching roller 38, the output carriage 14 carries two guide rollers 36, 37 (FIG. 8) associated with the front belt 2. At that end of the horizontal section 23 which forms part of the pinching zone, the front belt 2 makes a first turn around the guide roller 36 through an angle which is within the range of 0 to 30 degrees and is oriented upwards in order to pass into the section 24, then makes a second turn around the detour roller 37 located outside its closed path 20 to 31 and through a negative angle greater than 180 degrees so as to pass into the horizontal section 25, and finally makes a third turn through 180 degrees around the pinching roller 38 in order to pass into the horizontal section 26 which extends immediately above the apron 8 and then to meet a stationary-shaft guide roller 39 located on the front side 7 of the spreading and lap-forming unit. The total deviation of the front belt 2 around the guide rollers 36, 37, 38 carried by the output carriage 14 is zero.

The auxiliary carriages 16, 18 are capable of displacement in translational motion in a horizontal direction perpendicular to the axes of the rollers 32 to 43, 60 to 69. The auxiliary carriages 16, 18 are located in a bottom passageway 70 which extends beneath the apron 8, at a distance from the zones in which the web 4 and the formed lap 6 pass. The bottom passageway 70 is separated from the apron 8 by a horizontal partition-wall 72.

The auxiliary carriage 16 is designed to maintain constant the length of the closed path 20 to 31 which is followed by the front belt 2. Said auxiliary carriage is adapted to carry a guide roller 41 about which the front belt 2 performs a 180-degree turn. The front belt 2 is guided between the main carriages 10, 14 and the auxiliary carriage 16 by stationary-shaft guide rollers 32, 33, 39, 40, 42, 43 located on the front side 7 of the spreading and lap-forming unit.

The auxiliary carriage 18 is designed to maintain constant the length of the closed path 50 to 59 followed by the rear belt 5. Said auxiliary carriage is adapted to carry a guide roller 67 about which the rear belt 5 performs a 180-degree turn. The rear belt 5 is guided between the main carriages 10, 14 and the auxiliary carriage 18 by stationary-shaft guide rollers 65, 66, 68, 69 located on the rear side 9 of the spreading and lap-forming unit.

Figure 7:
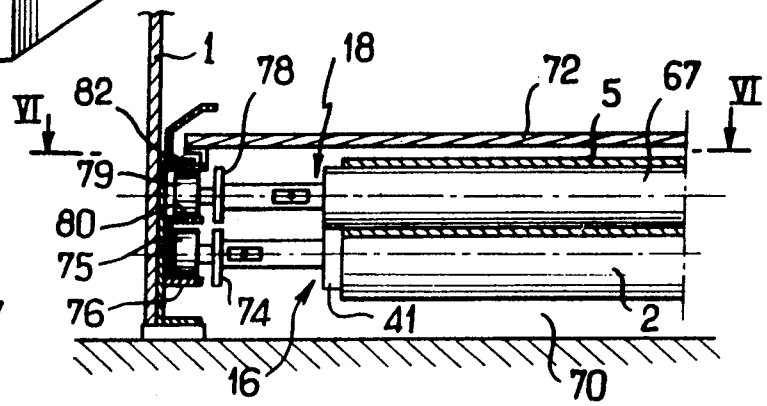
FIG. 7 is a partial plan view taken along the plane VII—VII indicated in FIGS. 4 and 6.
Figure 6:
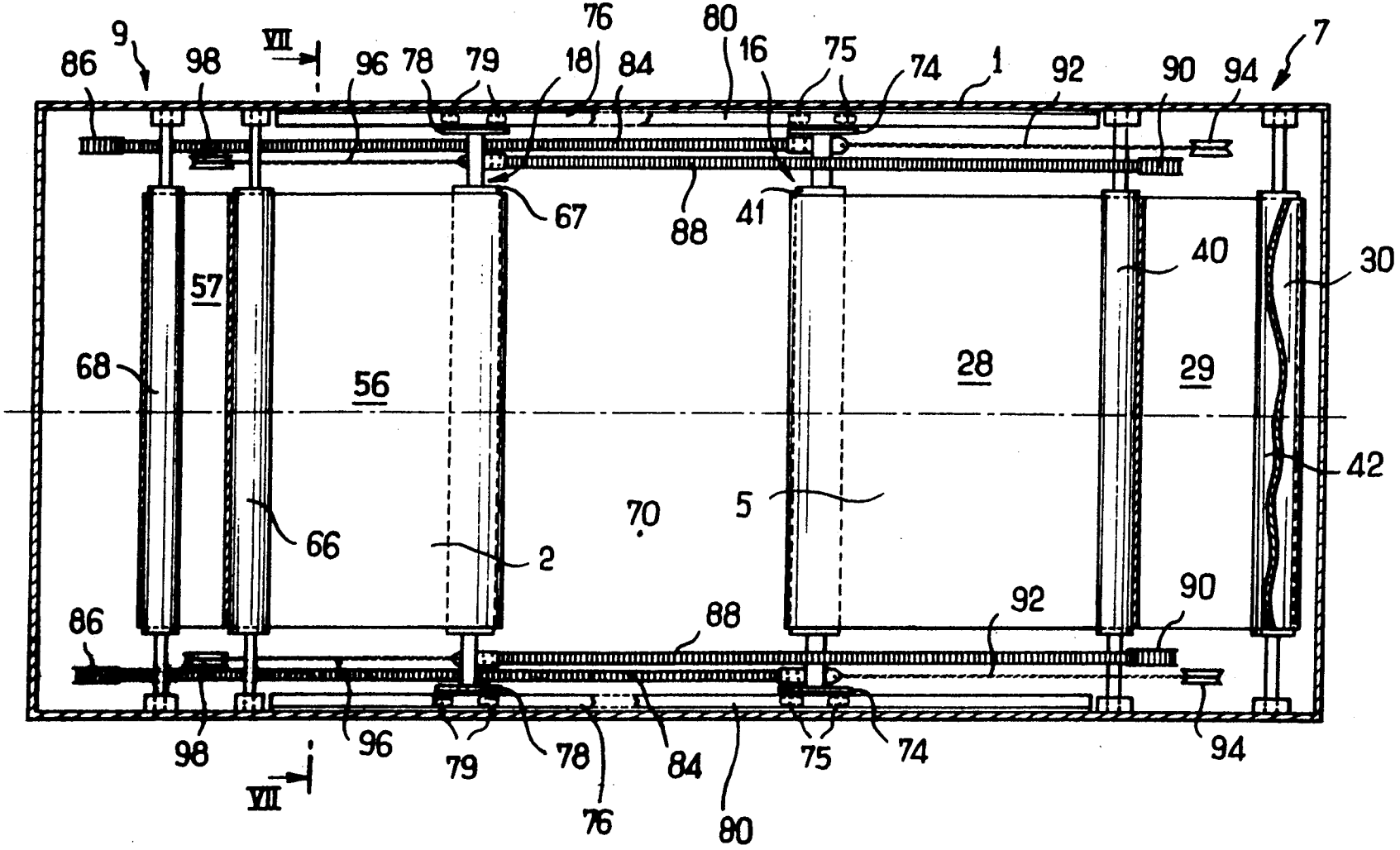
FIG. 6 is a plan view taken along the plane VI—VI indicated in FIGS. 4 and 7.

As shown in FIGS. 6 and 7, each auxiliary carriage 16, 18 has two side-plates 74, 78 located on each side of the roller 41, 67 which is carried by said carriage. The shaft ends of each roller 41, 67 are supported on the side-plates 74, 78 of the respective auxiliary carriage 16, 18. On the faces remote from the roller 41, 67, the side-plates 74, 78 carry wheels 75, 79 which are capable of pivoting about a horizontal axis and roll on horizontal side rails 76, 80 which are rigidly fixed to the frame 1 of the spreading and lap-forming machine in order to guide the auxiliary carriages 16, 18 in their movements of translation. The side rails 76, 80 extend within the bottom passageway 70 on each side of the rollers 41, 67. As is apparent from the partial view of FIG. 7, they are located at different heights. In the example shown in the figures, the bottom rails 76 support the auxiliary carriage 16 which guides the front belt 2 and the top rails 80 support the auxiliary carriage 18 which guides the rear belt 5. Above the wheels 79 of the carriage 18 placed on the top rails 80 extend lateral angle-iron members 82 which are rigidly fixed to the frame 1 and form a support for the partition-wall 72 which delimits the top portion of the passageway 70.

In order to impart motion to the main carriages 10, 14 and auxiliary carriages 16, 18, the spreading and lap-forming machine includes driving pinions 85, 89 driven in rotation by means (not shown) and disposed respectively in meshing engagement with toothed drive-belts 84, 88 represented schematically in dashed lines in FIGS. 2 to 4.

Two toothed drive-belts 84 extend on each side of the rollers and of the conveyor-belts between the input carriage 10 and the auxiliary carriage 16, via the rear side 9 of the spreading and lap-forming unit. Between the carriages 10 and 16 to which they are attached at the ends thereof, the toothed drive-belts 84 each pass around two guide pinions 85, 86 (including the driving pinion 85) which pivot respectively about a stationary shaft parallel to the axes of the rollers 32 to 43, 60 to 69. The pinions 85, 86 are so arranged that the end sections of the toothed drive-belts 84 are parallel to the direction of translational motion of the carriages 10, 16 to which they are attached respectively.

Similarly, two toothed drive-belts 88 extend on each side of the rollers and of the conveyor-belts between the output carriage 14 and the auxiliary carriage 18, via the front side 7 of the spreading and lap-forming unit. Between the carriages 14 and 18 to which they are attached at the ends thereof, the toothed drive-belts 88 each pass around two guide pinions 89, 90 (including the driving pinion 89) which pivot respectively about a stationary shaft parallel to the axes of the rollers 32 to 43, 60 to 69. The pinions 89, 90 are so arranged that the end sections of the toothed drive-belts 88 are parallel to the direction of translational motion of the carriages 14, 18 to which they are attached respectively.

Moreover, the main carriages 10, 14 and auxiliary carriages 16, 18 are coupled in pairs 10, 16 and 14, 18 by means of cables 92, 96 represented schematically by chain-dotted lines in FIGS. 2 to 4. These cables 92, 96 are less extensible than the conveyor-belts 2, 5.

Two cables 92 extend on each side of the rollers and of the conveyor-belts between the input carriage 10 and its associated auxiliary carriage 16, via the front side 7 of the spreading and lap-forming unit. Between the carriages 10 and 16 to which their ends are attached, the cables 92 each pass around two guide pulleys 93, 94 which pivot respectively about a stationary shaft parallel to the axes of the rollers 32 to 43, 60 to 69. The pulleys 93, 94 are so arranged that the end sections of the cables 92 are parallel to the direction of translational motion of the carriages 10, 16 to which they are attached respectively.

Two cables 96 extend on each side of the rollers and of the conveyor-belts between the output carriage 14 and its associated auxiliary carriage 18, via the rear side 9 of the spreading and lap-forming unit. Between the carriages 14 and 18 to which their ends are attached, the cables 96 each pass around two guide pulleys 97, 98 which pivot respectively about a stationary shaft parallel to the axes of the rollers 32 to 43, 60 to 69. The pulleys 97, 98 are so arranged that the end sections of the cables 96 are parallel to the direction of translational motion of the carriages 14, 18 to which they are attached respectively.

During operation, the displacement of the conveyor-belts 2, 5 is controlled by means of the driving rollers 39, 65 and the displacement of the carriages 10, 14, 16, 18 is controlled by means of the driving pinions 85, 89 which engage with the toothed drive-belts 84, 88. Synchronous reciprocating movements of translation are thus imparted to the carriages 10, 14, 16, 18. The kinematic laws to be applied to the main carriages 10, 14 can for example be those taught by patent document FR-B-2,234,395.

The end positions of the reciprocating movements are shown diagrammatically in FIGS. 2 and 3 and an intermediate position is shown in FIG. 4.

If L designates the width of the formed lap 6, the output carriage 14 and its associated auxiliary carriage 18 carry out reciprocating movements of amplitude L at instantaneous velocities having the same values and in opposite directions, with the result that the length of the closed path 50 to 59 followed by the rear conveyor-belt 5 is maintained constant. The input carriage 10 and its associated auxiliary carriage 16 carry out reciprocating movements having an amplitude of the order of L/2 at instantaneous velocities having the same values and in opposite directions, with the result that the length of the closed path 20 to 31 followed by the front conveyor-belt 2 is maintained constant.

These kinematic relationships between associated carriages are obtained by means of the cables 92, 96 which couple them together. In a first stage of the reciprocating movement from the position illustrated in FIG. 2 to the position illustrated in FIG. 3, the driving pinions 85, 89 are driven in the direction indicated by the arrows G in FIG. 2. The toothed drive-belts 84 then pull the input carriage 10 towards the rear side 9 and the toothed drive-belts 88 pull the auxiliary carriage 18 towards the front side 7. A tractive force towards the front side 7 is transmitted to the auxiliary carriage 16 by means of the cable 92 which couples it to the input carriage 10. A tractive force towards the rear side 9 is transmitted to the output carriage 14 by means of the cable 96 which couples it to the auxiliary carriage 18.

Symmetrically, in the second stage of the reciprocating movement from the position illustrated in FIG. 3 to the position illustrated in FIG. 2, the driving pinions 85, 89 are driven in the direction indicated by the arrows H in FIG. 3. The toothed drive-belts 84 then pull the auxiliary carriage 16 towards the rear side 9 and the toothed drive-belts 88 pull the output carriage 14 towards the front side 7. A tractive force towards the front side 7 is transmitted to the input carriage 10 by means of the cable 92 which couples it to the auxiliary carriage 16. A tractive force towards the rear side 9 is transmitted to the auxiliary carriage 18 by means of the cable 96 which couples it to the output carriage 14.

The above-mentioned tractive forces, which are useful for synchronizing the movements of the associated carriages, are advantageously absorbed by the cables 92, 96 since these latter are less extensible than the conveyor-belts 2, 5. This offers a great advantage in comparison with spreading and lap-forming devices of the prior art in which these tractive forces are essentially absorbed by the conveyor-belts. In consequence, the conveyor-belts are less subjected to stress and can be of lighter construction while having improved durability. The light construction of the conveyor-belts is very advantageous since it reduces the inertia of the machine and facilitates the motion in the curved regions of their closed paths, thus improving the regularity of transfer of the web 4 in these regions.

The web 4 delivered by the card is deposited on the inclined section 20 which is followed by the front conveyor-belt 2 (as shown in FIG. 4). After deviation on the roller 33, the web is conveyed horizontally on the section 21 up to the input carriage 10. On this carriage, the web 4 is first deviated by the roller 34 at an angle A ranging in value from 0 to 90 degrees. The moderate value of the angle A prevents any disturbance of the web when it is deviated by the roller 34. After having been conveyed on the inclined section 22 of the front conveyor-belt 2, the web 4 passes around the pinching roller 35. The pinching line defined between the rollers 35, 61 prevents any detachment of the web 4 from the front conveyor-belt under the action of centrifugal force. Since the web 4 describes a curve around the pinching roller 35 through an angle $B=180°-A$ within the range of 90 to 180 degrees and since the pinching line is located in an intermediate angular position along said curve, pinching between the rollers 35, 61 does not cause any disturbances in the inclined section 22 which precedes this pinching action.

In the event that the angle B is too large (180 degrees or more), undesirable detachments of the web immediately upstream of the pinching roller 35 could be observed at high rates of transfer as a result of excessive angular deviation or of a certain sag of the front conveyor-belt 2 upstream of the pinching roller 35. In the event that the angle B is too small (90 degrees or less), the web 4 would not be conveyed in a reliable manner on the excessively inclined section 22 which precedes the pinching roller 35. Preliminary pinching of the web 4 between the rollers 35, 61 and the suitable value of the angle B thus ensure the highest stability of transfer of the web, thus resulting in a lap 6 of optimum quality.

In the example of construction described, the roller 34 which deviates the web 4 through the angle A upstream of the pinching line is mounted on the input carriage 10. It will be understood that the roller 34 could have a stationary shaft with respect to the frame 1 of the spreading and lap-forming machine. In this case, the angles A and B are variable but the input carriage is lighter in weight and the roller 34 has the effect of supporting the conveyor-belt 2 upstream of the input carriage.

After having passed through the pinching zone 23, 53, the web 4 reaches the output carriage 14 which deposits it in alternate folds on the apron 8 so as to form the lap 6.

The formed lap 6 is sheltered to a certain extent from the air currents produced by the reciprocating movements of the carriages 10, 14, 16, 18 by virtue of the presence of the conveyor-belt sections 26, 54 located immediately above the apron 8. The presence of the vertical sections 27, 55 adjacent to these sections 26, 54 has the further effect of preventing lateral air currents from reaching the level of the formed lap 6. Since the auxiliary carriages 16, 18 move within the bottom passageway 70 of the spreading and lap-forming unit which is separated from the apron 8 by the partition-wall 72, the air currents produced by their movements remain essentially confined to the interior of the bottom passageway 70 at a distance from the zones in which the web 4 and the lap 6 pass. In consequence, neither the web 4 nor the lap 6 are disturbed by these air currents and homogeneity of the formed lap 6 is improved, in particular when the spreading and lap-forming unit operates at high speed.

Although, within the general scope of the invention, the auxiliary carriages can be located in separate and distinct bottom passageways, it is advantageous for the purpose of reducing the overall size to provide a single bottom passageway 70 in which the two auxiliary carriages 16, 18 move. Since the auxiliary carriages 16, 18 are placed on rails 76, 80 located at different heights within the bottom passageway 70, the drive-belts 84, 88 and the coupling cables 92, 96 are also placed at different heights and do not interfere with each other during operation.

The bottom passageway 70 has a length at least equal to 3L/2 or in other words to the sum of amplitudes of the reciprocating movements of the main carriages 10, 14 (or of the auxiliary carriages 16, 18).

It is of course possible to consider a number of different alternatives to the example of construction described in the foregoing while remaining within the scope of the present invention.

What is claimed is:

1. A spreading and lap-forming machine for converting a web (4) to a lap (6) by folding in pleats, comprising at least two conveyor-belts (2, 5) following separate closed paths (20 to 31, 50 to 59) and associated with rollers (32 to 43, 60 to 69) for respective guiding and displacement of said conveyor-belts, the closed paths (20 to 31, 50 to 59) being external to each other and adjacent to each other in a pinching zone (23, 53) delimited by guide rollers carried by two main carriages (10, 14) displaceable in translational motion in a horizontal direction at right angles to axes of the rollers (32 to 43, 60 to 69), compensating means including at least one auxiliary carriage (16, 18) displaceable in translational motion at right angles to the axes of the rollers (32 to 43, 60 to 69) so as to maintain the length of each closed path (20 to 31, 50 to 59) at a substantially constant value, each closed path (20 to 31, 50 to 59) making a 180-degree turn around at least one guide roller (41, 67) carried by said at least one auxiliary carriage (16, 18), means (20, 21, 22) for transporting the web (4) to the pinching zone (23, 53), an apron (8) movable in a direction parallel to the axes of the rollers (32 to 43, 60 to 69) and receives the web (4) as the web passes out of the pinching zone (23, 53), and driving means (84, 85, 88, 89) for applying reciprocating movements of translation to the main carriages (10, 14) and to the compensating means (16, 18), wherein each said at least one auxiliary carriage (16, 18) is located within a bottom passageway (70) which extends beneath the apron (8) and is separated therefrom by a partition-wall (72) whereby air currents generated in particular by the auxiliary carriages are prevented from propagating to the lap which is being formed.

2. A spreading and lap-forming machine according to claim 1, wherein the compensating means comprise a plurality of auxiliary carriages (16, 18) associated respectively with one of the closed paths (20 to 31, 50 to 59) and located within the bottom passageway (70).

3. A spreading and lap-forming machine according to claim 2, wherein the auxiliary carriages (16, 18) are slidably mounted respectively on side rails (76, 80) extending within the bottom passageway (70) on each side of said at least one roller (41, 67) which are carried by the auxiliary carriages (16, 18), said rails (76, 80) being at different heights.

4. A spreading and lap-forming machine according to claim 2, wherein the bottom passageway (70) has a length at least equal to sum (3L/2) of the amplitudes of the reciprocating movements of the two main carriages (10, 14), where L designates a width of the formed lap (6).

5. A spreading and lap-forming machine according to claim 1, wherein each main carriage (10, 14) is connected to an auxiliary carriage (16, 18) by coupling means (92, 96) which are less extensible than the conveyor-belts (2, 5) and so arranged as to be put under tension under action of the driving means (84, 85, 88, 89).

6. A spreading and lap-forming machine according to claim 1, wherein the driving means include at least one motion-transmission element (84, 88) engageable with a driving pinion (85, 89), said motion-transmission element (84, 88) attached at one end to a main carriage (10, 14) and at another end to said at least one auxiliary carriage (16, 18), said main carriage (10, 14) and said auxiliary carriage (16, 18) being also connected together by the coupling means (92, 96), the rotation of the driving pinion (85, 89) in one direction pulling the main carriage (10, 14) in a first stage of reciprocating motion and the rotation of the driving pinion (85, 89) in the other direction to pulling the auxiliary carriage (16, 18) in a second stage of the reciprocating motion.

* * * * *